US005675855A

United States Patent [19]

Culp

[11] Patent Number: 5,675,855

[45] Date of Patent: Oct. 14, 1997

[54] SELF-INFLATING AIR MATTRESS

[76] Inventor: Bill B. Culp, 20073 SE. Foster Rd., Boring, Oreg. 97009

[21] Appl. No.: 723,422

[22] Filed: Sep. 30, 1996

Related U.S. Application Data

[63] Continuation of Ser. No. 371,613, Jan. 12, 1995, which is a continuation of Ser. No. 89,169, Jul. 7, 1993, abandoned.

[51] Int. Cl.[6] ..... A47C 27/18; A47C 27/08

[52] U.S. Cl. ..... 5/709; 5/420; 5/932; 5/712

[58] Field of Search ..... 5/420, 709, 712, 5/654, 655.3, 655.5, 655.9, 656, 706, 707, 932

[56] References Cited

U.S. PATENT DOCUMENTS

| | | | |
|---|---|---|---|
| 1,332,933 | 3/1920 | Sylvester | 5/712 |
| 2,552,476 | 5/1951 | Barton . | |
| 2,620,493 | 12/1952 | Brelsford | 5/709 |
| 2,781,820 | 2/1957 | Rogers . | |
| 3,017,642 | 1/1962 | Rosenberg et al. . | |
| 3,133,696 | 5/1964 | Mirando . | |
| 3,323,151 | 6/1967 | Lerman . | |
| 4,428,087 | 1/1984 | Horn . | |
| 4,607,404 | 8/1986 | Fraige . | |
| 4,942,634 | 7/1990 | Saloff et al. | 5/654 |
| 4,952,439 | 8/1990 | Hanson . | |
| 5,113,540 | 5/1992 | Sereboff | 5/654 |
| 5,265,293 | 11/1993 | Spahn et al. . | |
| 5,329,656 | 7/1994 | Leggett | 5/712 |

*Primary Examiner*—Alexander Grosz
*Attorney, Agent, or Firm*—Keith A. Cushing

[57] ABSTRACT

A self-inflating air mattress includes an air chamber and a foam panel therein. The air chamber is defined by top and bottom sheet panels and a valve allowing air passage into and out of the air chamber. The foam panel includes apertures therethrough, and the top and bottom sheet panels are mechanically coupled directly together via the apertures in the foam panel. As a result, the foam panel need not be mechanically connected to the top and bottom sheet panels and improved air flow within the chamber results. Furthermore, by virtue of the direct mechanical coupling between top and bottom sheet panels distributed throughout the air mattress, the top and bottom sheet panels are limited in their relative spacing and the air mattress tends to better support any weight placed thereon, there being no pillowing of the air mattress in response to weight placed thereon.

6 Claims, 2 Drawing Sheets

SELF-INFLATING AIR MATTRESS

The present application is a continuation of U.S. patent application Ser. No. 08/371,613 filed Jan. 12, 1995 by applicant herein which was a file wrapper continuation of U.S. patent application Ser. No. 08/089,169 filed on Jul. 7, 1993 by applicant, now abandoned, and entitled Self-Inflating Air Mattress.

BACKGROUND OF THE INVENTION

The present invention relates generally to air mattresses, and particularly to self-inflating air mattresses.

Inflatable air mattresses are convenient because of their collapsibility, i.e., ability to be rolled into cylindric configuration, and portability. Inflatable mattresses have application across a broad spectrum of use from suntanning to exercise to camping. An inflatable air mattress is generally a flat body provided by a sealed air chamber formed by top and bottom panels joined along the periphery of the mattress to define an air chamber. An air valve admits and releases air from the chamber. A traditional air mattress is inflated by opening the valve and introducing, by mouth or pump, air into the chamber and then closing the valve to capture the air in the chamber. The captured air then provides support against weight applied to the mattress. By releasing the valve, the air can escape and the mattress can be rolled for storage or transportation.

A self-inflating air mattress improves on the basic inflatable air mattress by eliminating, or at least assisting in, the process of manually introducing air into the chamber. Self-inflating mattresses include a collapsible, resilient material, e.g., a foam structure with open cells, located within the air chamber. When the mattress is rolled in its cylindric condition, with the valve open, air escapes from the foam structure and out of the chamber. When the mattress is unrolled, the resilient foam structure expands and draws air into itself, and also into the air chamber through the air valve. As a result, the air chamber is filled, or at least partially filled, with air by virtue of the expansion of the foam structure within the air chamber.

In use of a self-inflating air mattress, the valve is opened to allow escape of air and the mattress is rolled to press air out of the foam structure and out of the air chamber. With the air mattress held in its collapsed or compressed state, the valve is closed to prevent reintroduction of air into the air chamber. As a result, the foam structure is unable to expand and the air mattress remains in a collapsed condition. When the valve is later released, the resilient foam structure expands and draws air into the chamber as described above, after which the valve is closed to capture air within the chamber.

Important characteristics of a self-inflating air mattress are the speed of inflation and deflation, and the amount of support provided. The mattress should quickly inflate and deflate, allow relatively free air movement within the foam structure and along the air chamber toward and from the valve.

SUMMARY OF THE INVENTION

A self-inflating air mattress according to the prevent invention includes an air chamber comprising top and bottom panels in face-to-face relation and sealably joined along peripheral edges to form an air chamber therebetween. A valve allows selective communication of air flow between the air chamber and an external body of air. A collapsible and resilient internal panel structure capable of collecting air while going from a collapsed condition to an expanded condition and ejecting air while going from an expanded condition to a collapsed condition rests within the air chamber and includes at least one aperture therethrough. The top and bottom panels are joined through the at least one aperture in the internal panel structure so as to maintain a mechanical connection between the top and bottom panels for structure integrity of the air mattress system. According to a preferred embodiment of the present invention, the air mattress includes a plurality of such apertures in the internal foam structure and a corresponding plurality of points of coupling between the top and bottom panels.

Overall, the air mattress system of the present invention enjoys strong and well distributed mechanical coupling directly between the panels defining the air chamber, yet permits sufficient air flow into and from the internal panel structure and also along the air chamber to and from the air valve to support rapid inflation and deflation.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
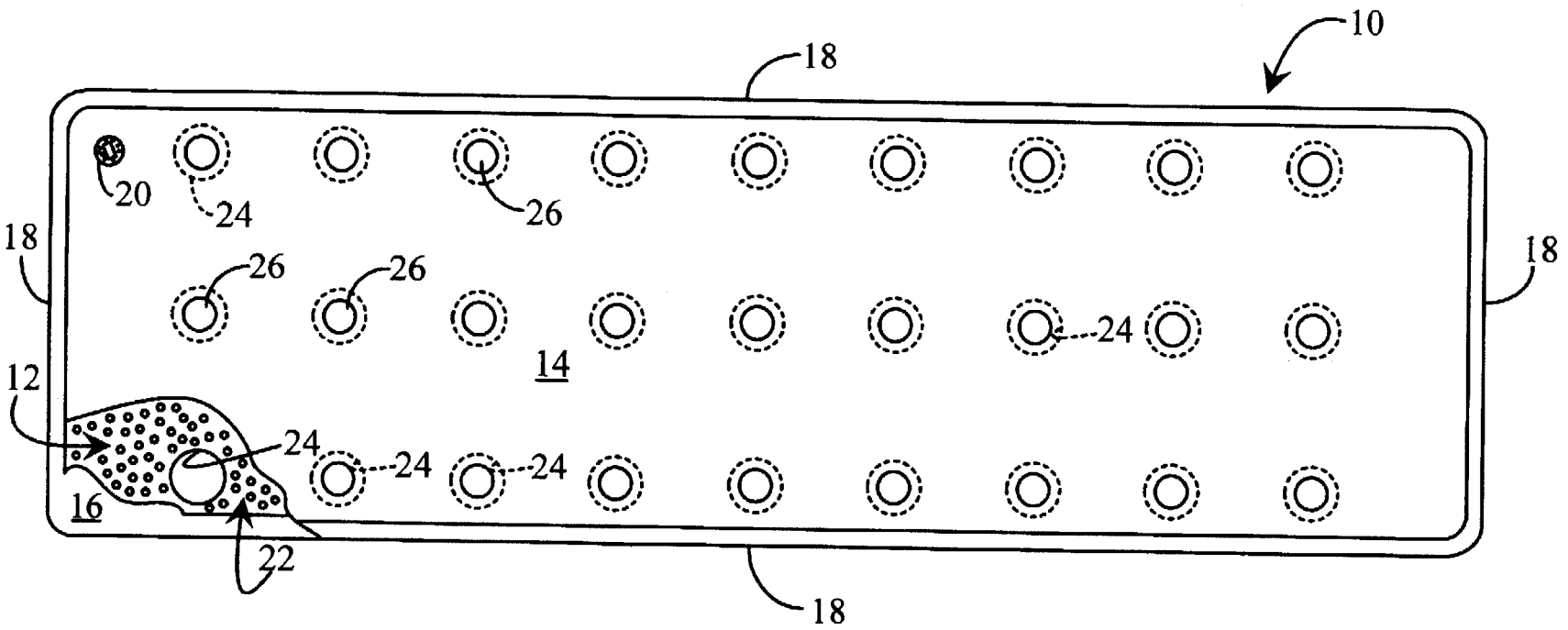
FIG. 1 is a plan view, partially broken away, illustrating a self-inflating air mattress according to a preferred embodiment of the present invention.

The preferred embodiment of the invention as illustrated in the drawings comprises generally a self-inflating air mattress useful for such applications as camping mattresses, exercise pads, and the like. The self-inflating air mattress of the present invention is characterized by its rapid inflation and deflation capabilities and good structural integrity resulting from direct mechanical coupling between the panels of the air chambers. As a result, separation between the panels of the air chambers is limited and no "pillowing" of the air mattress occurs when supporting weight. In prior self-inflating air mattresses, mechanical coupling between the panels of the air chamber, for the purpose of limiting separation therebetween, was indirect by coupling each to the foam structure therebetween. As a result, such prior self-inflating air mattresses suffered from insufficient air flow within the chamber, and therefore had relatively slower inflation and deflation capability.

FIG. 1 illustrates a self-inflating air mattress 10 according to a preferred embodiment of the present invention. In the plan view, partially broken away, of FIG. 1, air mattress 10 includes an air chamber 12 defined by a top sheet panel 14 and a bottom sheet panel 16 sealably joined together about the periphery of mattress 10 by a seam 18. Top panel 14 includes therethrough a valve 20 operable by manual rotation thereof between an open condition and a closed condition. Valve 20 may take a variety of forms, its function being to selectably allow passage of air into or out of the air chamber 12. Thus, air may be selectably removed from and drawn into air chamber 12 by use of valve 20.

A collapsible, resilient open celled foam panel 22 rests within air chamber 12. The function of foam panel 22 is to aid in the inflation of chamber 12, and also provide additional support in use of mattress 10. More particularly, foam panel 22 can be collapsed by pressing thereon to cause escape of air from the interior of foam panel 22. Foam panel 22, due to its resiliency, expands upon release of such pressure and draws air into its interior. By placing such a foam panel within the air chamber 12, air mattress 10 is self-inflating, i.e., drawing air into the air chamber 12 upon its expansion from a collapsed state. As with traditional self-inflating air mattresses, air mattress is rolled into cylindric configuration to compress foam panel 22 and push air out of foam panel 22 and air chamber 12. In such collapsed condition, valve 20 is closed to prevent re-introduction of air into chamber 12, i.e., prevent expansion of foam panel 22 and maintain air mattress 10 in a collapsed condition. Upon later opening valve 20, foam panel 22 expands, draws air into its interior portion, and thereby inflates air chamber 12.

Foam panel 22 includes a well distributed grid array of apertures 24 therethrough, one such aperture 24 being shown directly by cutting away top panel 14 in FIG. 1, the remaining apertures 24 being shown in phantom in FIG. 1. Top panel 14 and bottom panel 16 join through apertures 24 at weld points 26 according to the same grid pattern of apertures 24. Thus, weld points 26 provide well distributed direct mechanical coupling between top panel 14 and bottom panel 16 yet without direct mechanical coupling to the foam structure 22.

Figure 2:
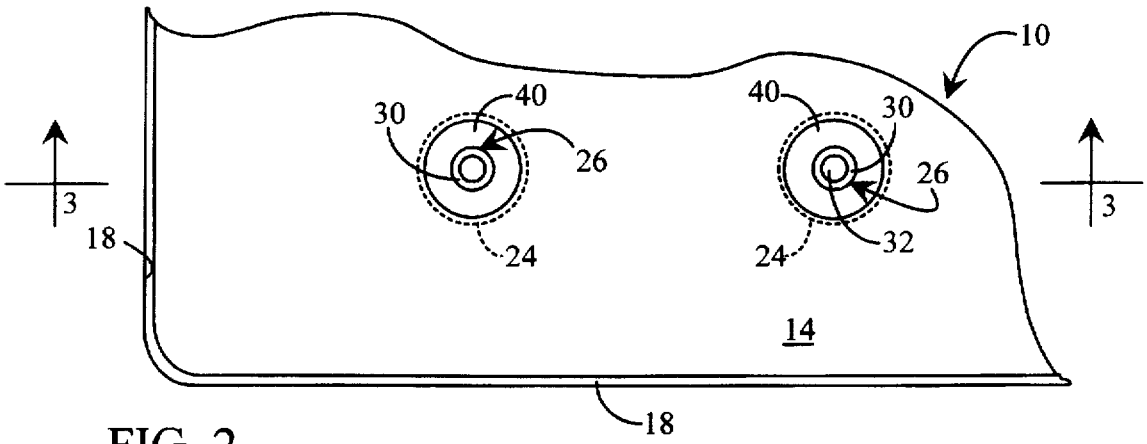
FIG. 2 is a more detailed partial plan view of the air mattress of FIG. 1.
Figure 3:
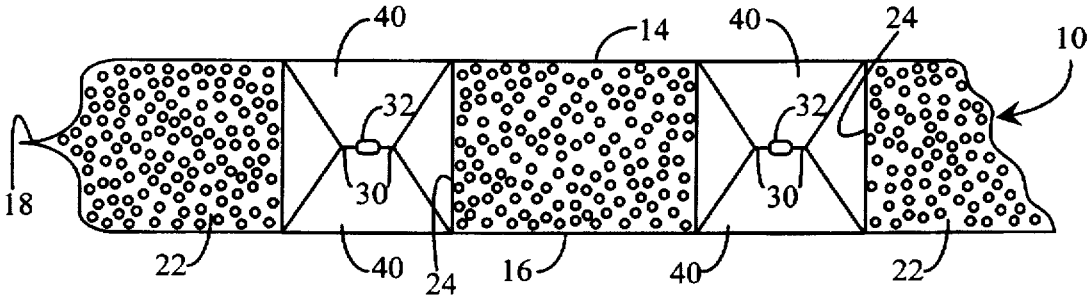
FIG. 3 is a sectional view of the air mattress of FIG. 2 taken along lines 3—3 of FIG. 2 and illustrating in more detail the direct mechanical coupling of top and bottom panels of the air chamber through apertures of a foam structure within the air chamber.
Figure 4:
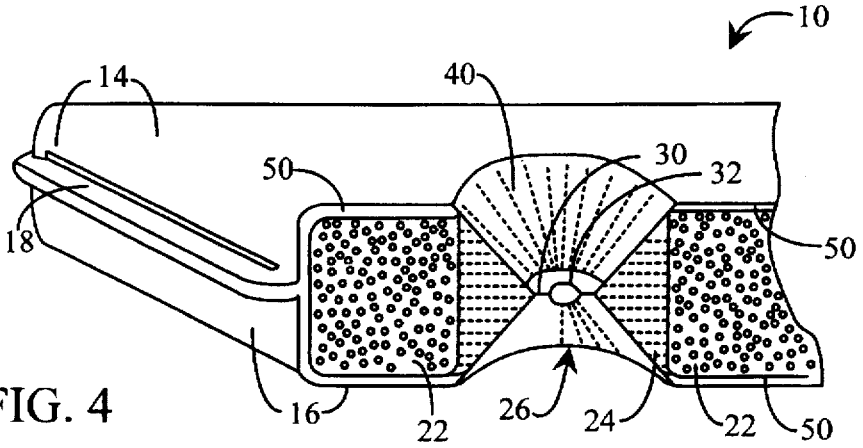
FIG. 4 is a perspective view of the air mattress of the present invention illustrating in more detail the direct coupling of top and bottom panels of the air chamber and the relative positioning of a collapsible, resilient foam structure within the air chamber.

FIGS. 2–4 illustrate in more detail the apertures 24 in foam panel 22, weld points 26, and the operating relationship between foam panel 22 and air passageways of the air chamber 12. In FIGS. 2–4, each weld point 26 includes an annular weld region 30 whereat panels 14 and 16 are joined and a center region 32 wherein panels 14 and 16 are not directly joined. The specific configuration of each weld point 26 will very, however, with the type of material used and the type of coupling used. In any event, the weld points 25 rest generally at a mid-depth point along each aperture 24. Panels 14 and 16 thereby form conic structures 40 as they extend from the top and bottom surfaces of mattress 10 inward to join with the other panel at the weld point 26. As may be appreciated, dimensioning of the top and bottom panels 14 and 16, respectively, should take into consideration the need to collect material to extend into the apertures 24 in forming the weld points 26. In other words, top and bottom panels 14 and 16 are somewhat loose prior to forming of the weld points 26, and after forming the weld points 26 come to a desired tightness in formation of the self-inflating air mattress 10.

Because of the distribution of weld points 26 throughout the mattress 10, the top panel 14 and bottom panel 16 are directly mechanically joined together. Air mattress 10 has good control, i.e., distribution, against any adverse "pillowing" effect caused by application of force to the air mattress 10, i.e., caused by someone laying or sitting upon the air mattress 10. Without such mechanical coupling, the panels 14 and 16 would tend to more widely separate under the increased air pressure in regions of air chamber 12 not directly supporting the load. As a result, any supporting air pressure present in the air chamber 12 is generally directed away from the area of support, and the mattress would tend to collapse and provide little or no support. Because panels 14 and 16 are directly joined and restricted in separation therebetween, however, adverse pillowing affect does not occur. In other words, the arrangement of weld points 26 as distributed throughout the air mattress 10 controls any pillowing affect by distributing such pillowing throughout air mattress 10 and thereby minimizing any adverse pillowing. Furthermore, the distribution of weld points 26 and the distributed minimal pillowing occurring throughout air mattress 10, provides improved contouring, i.e., better support at more points along the person's body, and therefore a more comfortable use of air mattress 10. As a result, air mattress 10 provides more uniform support throughout without any portions flattening completely, and thereby failing to provide comfortable support.

The arrangement of foam panel 22 and mechanical interconnecting of top and bottom panels 14 and 16, respectively, also permits high volume air flow throughout air chamber 12 during inflation and deflation of air mattress 10. With specific reference to FIG. 4, it should be noted that the foam panel 22 need not be directly coupled to, i.e., laminated to, the panels 14 and 16. As a result air flow passageways 50 reside between the foam panel 22 and the top and bottom panels 14 and 16, respectively. Also, by virtue of the apertures 24 in foam panel 22, additional surface area in panel 22 results and, therefore, more opportunity for air to flow into and out of the foam panel 22. Overall, air movement within air chamber 12 is improved, there being little impediment to air flow once the air is escapes foam panel 22 during deflation and once air enters valve 20 during inflation. As a result, the self-inflating air mattress 10 of the present invention has relatively quick inflation and deflation capabilities.

While the present invention may be implemented according to a variety of materials and methods, the most preferred form of the invention for general use, i.e., camping and exercise applications, would include as the top and bottom panels 14 and 16, respectively, a nylon material, including a PVC and/or polyurethane coating on the inner surface of each panel 14 and 16. The foam panel 22 is preferably a polyurethane pre-crushed foam material having a weight per cubic foot on the 1.6 to 1.8 with firmness on the order of 30 ILD. The weld points 26 may be implemented using high frequency sonic welding techniques.

The method of construction suggested under the present invention includes first establishing a grid pattern for the weld points 26. For example, a spacing of 6.4 inches along the length and a spacing of 6 inches across the width of mattress 10 has provided adequate mechanical coupling of the panels 14 and 16 and also good air flow within the air chamber 12. Apertures 24 follow the same grid pattern, but are of sufficiently large dimension to allow formation of the weld points 26 at a mid-point, i.e., mid-depth point, thereal-long. A radius of 0.75 inches for the apertures 24 has been found acceptable, with a 0.25 inch outside radius for the annular weld regions 30 of weld points 26. Thus, the widest portion of the conic portions 40 of weld points 26 are on the order of 0.75 inches radius.

Thus, an improved self-inflating air mattress has been shown and described. The air mattress of the present invention provides appropriate structural support, i.e., direct coupling between the top and bottom panels, to prevent pillowing of the air chamber when receiving a load. Furthermore, the air mattress of the present invention provides improved air flow within the air chamber to support more rapid inflation and deflation capability, even with a more dense or thick foam. Because of the improved air flow and structural coupling between the top and bottom panels 14 and 16, the air mattress of the present invention allows use of a relatively more thick foam panel 22 than found in conventional self-inflating air mattresses. Thus, the air mattress of the present invention can provide even greater support by virtue of this thicker and more comfortable interior foam panel 22.

It will be appreciated that the present invention is not restricted to the particular embodiment that has been described and illustrated, and that variations may be made therein without departing from the scope of the invention as found in the appended claims and equivalents thereof. For example, a variety of materials and construction techniques may be employed to implement an air mattress under the present invention. Such materials and construction techniques are known and may be employed to accomplish specific objectives of the air mattress such as thermal, waterproof, and comfort features of the air mattress.

What is claimed is:

1. A self-inflating air mattress comprising:

an air chamber comprising top and bottom panels in face-to-face relation and sealably joined along peripheral edges to form said air chamber therebetween, said air chamber having a full volume capacity;

a valve selectively communicating an air flow between said air chamber and an external body of air; and a collapsible and resilient self-expanding internal panel structure, comprised of an open celled foam material having an upper and a lower surface and capable of collecting air while expanding under its resiliency from a collapsed condition to an expanded condition, said expanded condition being of volume substantially equal to said air chamber full volume capacity, and ejecting air while collapsing from an expanded condition to a collapsed condition, said internal panel structure being positioned freely within said air chamber relative to said top and bottom panels in such manner as to allow free passage of air along said upper and lower surfaces of said internal panel, directly, without obstruction to and from said valve, said internal panel including at least four apertures, distributed in a grid pattern, with said top and bottom panels extending into said apertures and being welded to each other at weld points generally at a mid-depth point along each aperture.

2. A mattress according to claim 1 wherein said top and bottom panels are nylon sheet panels.

3. A mattress according to claim 1 wherein said internal panel structure is a polyurethane foam material.

4. A self-inflating air mattress comprising:

an air chamber comprising top and bottom panels in face-to-face relation and sealably joined along peripheral edges to form said air chamber therebetween, said air chamber having a full volume capacity;

a valve selectively communicating an air flow between said air chamber and an external body of air; and a collapsible and resilient self-expanding internal panel structure, comprised of an open celled foam material having an upper and a lower surface and capable of collecting air while expanding under its resiliency from a collapsed condition to an expanded condition, said expanded condition being of volume substantially equal to said air chamber full volume capacity, and ejecting air while collapsing from an expanded condition to a collapsed condition, said internal panel structure being positioned freely within said air chamber relative to said top and bottom panels in such manner as to allow free passage of air along said upper and lower surfaces of said internal panel, directly, without obstruction to and from said valve, said internal panel including at least four apertures, distributed in a grid pattern, with said top and bottom panels extending into said apertures and being welded to each other at an annular weld region in which the top and bottom panels are joined to each other and which surrounds a center region in which said top and bottom panels are not joined.

5. A mattress according to claim 4 wherein said top and bottom panels are nylon sheet panels.

6. A mattress according to claim 4 wherein said internal panel structure is a polyurethane foam material.

* * * * *